US008989399B2

(12) United States Patent
Baggs

(10) Patent No.: US 8,989,399 B2
(45) Date of Patent: Mar. 24, 2015

(54) REFLECTION CANCELLING BOUNDARY MICROPHONES AND AMPLIFICATION SYSTEMS INCORPORATING REFLECTION CANCELLING BOUNDARY MICROPHONES

(75) Inventor: Lloyd R. Baggs, Nipomo, CA (US)

(73) Assignee: Lloyd Baggs Innovations, LLC, Nipomo, CA (US)

( * ) Notice: Subject to any disclaimer, the term of this patent is extended or adjusted under 35 U.S.C. 154(b) by 1257 days.

(21) Appl. No.: 12/759,874

(22) Filed: Apr. 14, 2010

(65) Prior Publication Data

US 2010/0260347 A1 Oct. 14, 2010

Related U.S. Application Data

(60) Provisional application No. 61/212,762, filed on Apr. 14, 2009.

(51) Int. Cl.
*H04R 3/00* (2006.01)

(52) U.S. Cl.
CPC ..... *H04R 3/007* (2013.01)
USPC ..... 381/71.2; 381/111; 381/122

(58) Field of Classification Search
USPC ..... 381/71.2, 111–115, 92, 122, 99
See application file for complete search history.

(56) References Cited

U.S. PATENT DOCUMENTS 4,361,736 A * 11/1982 Long et al. ..... 381/361
4,563,933 A * 1/1986 Kim ..... 84/267
6,122,385 A * 9/2000 Konno et al. ..... 381/96
2005/0063553 A1* 3/2005 Ozawa ..... 381/92
2006/0093158 A1* 5/2006 Noro ..... 381/97
2008/0205669 A1* 8/2008 Michelet ..... 381/118
2009/0010453 A1* 1/2009 Zurek et al. ..... 381/94.5
2009/0114080 A1* 5/2009 Uehara ..... 84/600
2009/0175463 A1* 7/2009 Lee et al. ..... 381/71.6
2014/0205106 A1 7/2014 Linn et al.

FOREIGN PATENT DOCUMENTS

GB 1317112 * 5/1973

OTHER PUBLICATIONS

Anderson, Roger et al., "A Distant Micing Technique," dB Magazine, Apr. 1971, vol. 5, No. 4, pp. 29-31, Retrieved from http://vvww.preservationsound.com/wp-content/uploads/2014/04/Distant_Micing.pdf on Jul. 7, 2014.

* cited by examiner

*Primary Examiner* — Duc Nguyen
*Assistant Examiner* — George Monikang
(74) *Attorney, Agent, or Firm* — KPPB LLP

(57) ABSTRACT

Reflection cancelling boundary microphones are described in which a microphone capsule is mounted within the pressure zone of a vibrating surface and the microphone is tuned in such a way as to cancel pressure waves reflected by the surface while admitting pressure waves generated by the vibration of the surface. One embodiment of the invention includes a microphone capsule configured to be mounted within the pressure zone of a vibrating surface. In addition, the microphone is tuned to cancel pressure waves reflected by the surface while admitting pressure waves generated by the vibration of the surface.

22 Claims, 10 Drawing Sheets

REFLECTION CANCELLING BOUNDARY MICROPHONES AND AMPLIFICATION SYSTEMS INCORPORATING REFLECTION CANCELLING BOUNDARY MICROPHONES

CROSS-REFERENCE TO RELATED APPLICATION

The current application claims priority to U.S. Provisional Application No. 61/212,762, filed Apr. 14, 2009, the disclosure of which is incorporated herein by reference.

FIELD OF THE INVENTION

The present invention relates generally to amplification systems and more specifically to microphones that can be used in the amplification of vibrating surfaces.

BACKGROUND

Microphones are regarded as the highest fidelity and best method to record acoustic instruments. Artists performing with acoustic instruments have been limited in their ability to employ external microphones due to feedback, loud bands and the requirement to stay in one place. Microphones have been tried inside of acoustic instruments with limited success due to feedback and undesirable resonances present inside of the instruments.

In a number of instances, internal microphones have been paired with under saddle or magnetic pickups with some modest success. However, the microphone is used very sparingly to avoid such things as feedback and undesirable resonances. The Duet, manufactured by L.R. Baggs Corporation of Nipomo, Calif., was one of the first successful microphone/pickup combinations. The Duet uses a crossover tuned to 1500 Hz and blended the fundamental and first harmonic range of the pickup with the upper harmonics of the microphone. This system could be played at very high sound pressure levels (SPLs) without feedback and with good fidelity.

A variety of specialized microphones are used in other applications. For example, boundary microphones are used in applications including monitoring full room sound. A boundary microphone is characterized in that it is mounted within the "pressure zone" proximate a rigid boundary and generates a signal indicative of the totality of the ambient sound reflected by the boundary. Boundary microphones are described in U.S. Pat. No. 4,361,736 to Long et al., the disclosure of which is incorporated herein by reference in its entirety. Long et al. describe that placing the diaphragm of the microphone capsule parallel to and facing the plate boundary provided by the microphone package enables the microphone to completely remove unwanted variations in the spectra of the output signal in the selected frequency range due to the cancellation and additions which would otherwise be caused by the interaction of the direct acoustical signal and the acoustical signal reflected from the proximate boundary. Long et al. explain that this is due to the fact that the microphone is operated in a mode in which the microphone senses only the variation in acoustical pressure and cannot discriminate with respect to the direction or angle of incidence of the sound. Long et al. note that it is essential that the diaphragm be shielded from all acoustic signals except those reflected from the boundary.

Another type of microphone is a noise cancelling microphone, which is a microphone designed to filler out ambient noise from the desired sound. Noise cancelling microphones typically utilize a noise cancelling capsule that is very proximity sensitive and includes at least two ports, where the front port is oriented toward the desired sound and the other port is more distant. A noise cancelling capsule's diaphragm is typically placed between the two ports; sound arriving from an ambient sound field reaches both ports more or less equally. Sound that's much closer to the front port than to the rear will make more of a pressure gradient between the front and back of the diaphragm, causing it to move more. A noise cancelling microphone capsule's proximity effect can be adjusted so that a flat frequency response is achieved for sound sources very close to the front of the microphone. Noise cancelling microphone capsules were developed specifically for telecommunications applications such as cell phones, headset microphones, etc. where rejection of background noise is paramount.

SUMMARY OF THE INVENTION

Reflection cancelling boundary microphones in accordance with embodiments of the invention are described, which include a microphone capsule that is configured to be positioned within the pressure zone of a vibrating surface. Reflection cancelling boundary microphones are distinct from other boundary microphones in that they are tuned in such a way as to cancel pressure waves reflected by a surface while admitting pressure waves generated by the vibration of the surface. In contrast to a conventional boundary microphone, where the reflections from the surface are the primary source of the sound, the primary source of a reflection cancelling boundary microphone is the surface itself. The ability of the reflection cancelling boundary microphone to differentiate between direct and reflected sound pressure to isolate the direct sound can be termed the zero effect, which references the zeroing of reflections. When a reflection cancelling boundary microphone is mounted internally to a musical instrument, the zero effect of the microphone cancels reflections from inside of the instrument (i.e., from secondary surfaces) that strike the vibrating surface. By eliminating the internal reflections, the microphone generates an audio signal similar to that obtained using an external microphone. In the case of a reflection cancelling boundary microphone mounted within the soundbox of an acoustic guitar, the zero effect cancels the internal reflections that would tend to overwhelm other types of microphones, were they to be placed inside a guitar. In several embodiments, the signal generated by a reflection cancelling boundary microphone is combined with the signal from a pickup with the assistance of a crossover.

One embodiment of the invention includes a microphone capsule configured to be mounted within the pressure zone of a vibrating surface. In addition, the microphone is tuned to cancel pressure waves reflected by the surface while admitting pressure waves generated by the vibration of the surface.

In a further embodiment, the microphone capsule is a noise cancelling microphone capsule including at least a front port and rear port, and the microphone capsule is mounted so that the front port of the noise cancelling capsule is directed toward the vibrating surface.

In another embodiment, the microphone capsule is selected from the group consisting of noise cancelling capsules, unidirectional capsules, cardioid capsules, omni capsules and combinations of capsules.

In a still further embodiment, the microphone capsule is mounted to filler mechanically borne frequencies in the operating range of the microphone.

In still another embodiment, microphone capsule is mounted to an armature, and the armature is suspended via elastomer supports.

In a yet further embodiment, the microphone capsule is configured to be mounted within 1 inch of the vibrating surface.

In yet another embodiment, the microphone capsule is configured to be mounted within half an inch of the vibrating surface.

In a further embodiment again, the microphone capsule is configured to be mounted within 3 mm of the vibrating surface.

In another embodiment again, the microphone capsule is configured to be mounted within 1 mm of the vibrating surface.

In a further additional embodiment, the microphone capsule is mounted within a microphone case that includes openings to provide a path for pressure waves incident on the vibrating surface to reach the microphone capsule.

Another additional embodiment includes, a reflection cancelling boundary microphone, including a microphone capsule configured to be mounted within the pressure zone of a vibrating surface of a musical instrument. In addition, the microphone is tuned to cancel pressure waves reflected by the surface while admitting pressure waves generated by the vibration of the surface.

In a still yet further embodiment, the reflection cancelling boundary microphone is configured to be mounted on an internal surface of a musical instrument.

In still yet another embodiment, the reflection cancelling boundary microphone is configured to be mounted on an external surface of a musical instrument.

A still further embodiment again includes a pickup configured to generate a signal indicative of sound, and a crossover. In addition, the crossover combines the output of the reflection cancelling boundary microphone and the pickup.

In still another embodiment again, the pickup is selected from the group consisting of undersaddle, magnetic, soundhole, and stick-on pickups.

In a still further additional embodiment, the pickup is an undersaddle pickup.

In still another additional embodiment, the crossover is configured to filler the output of the reflection cancelling boundary microphone to select frequencies above a crossover frequency that is higher than a primary resonant frequency of a musical instrument.

In a yet further embodiment again, the musical instrument is an acoustic guitar, and the crossover frequency is at least 250 Hz.

In yet another embodiment again, the crossover is further configured to filler the output of the pickup to select frequencies below the crossover frequency.

A yet further additional embodiment also includes a mixer. In addition, the crossover is configured to high pass filler the output of the reflection cancelling boundary microphone to select frequencies above a crossover frequency that is higher than a primary resonant frequency of a musical instrument, the crossover is configured to high pass filler the output of the pickup to select frequencies above the crossover frequency, the mixer is configured to blend the high pass filtered outputs of the reflection cancelling boundary microphone and the pickup, the crossover is also configured to low pass filter the output of the pickup, and the crossover is configured to combine the output of the mixer with the low pass filtered output of the pickup.

In yet another additional embodiment, the microphone and the pickup are mounted within a unitary housing.

In a still yet further embodiment again, the pickup is any transducer that generates a signal indicative of the low frequency sound generated by the instrument.

In still yet another embodiment again, the pickup can be selected from the group consisting of an undersaddle pickup, and a film pickup internal to the unitary housing.

A still yet further additional embodiment also includes a crossover. In addition, the crossover is configured to split a signal generated by the RCBM and separately filter the high frequency and low frequency components of the signal and then recombines the filtered components to provide a crossover output signal.

Still yet another additional embodiment includes a microphone input, a pickup input, an output, a crossover, and a mixer. In addition, the crossover is configured to high pass filler the signal received via the microphone input to select frequencies above a crossover frequency, the crossover is configured to high pass filler the signal received via the pickup input to select frequencies above the crossover frequency, the mixer is configured to blend the high pass filtered signals, the crossover is also configured to low pass filler the signal received via the pickup input, and the crossover is configured to combine the output of the mixer with the low pass filtered signal and provide the combined signal to the output of the unit.

DETAILED DESCRIPTION OF THE INVENTION

Figure 1A:
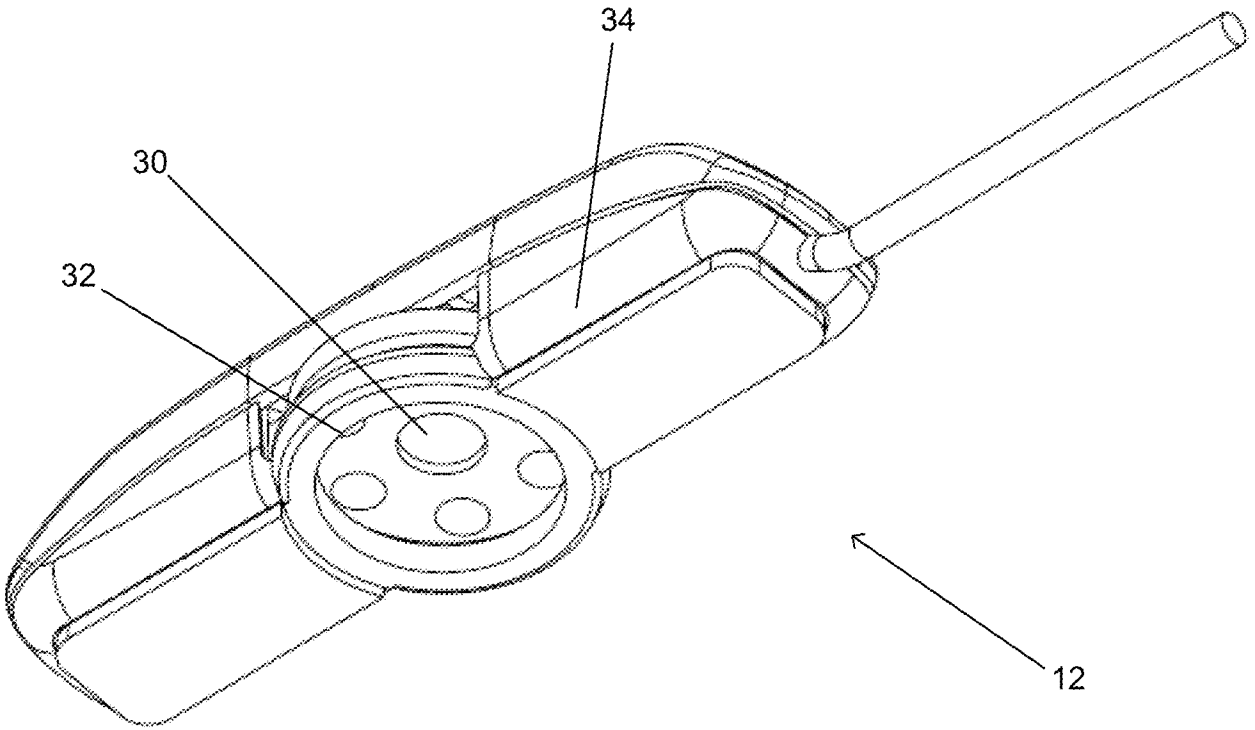
FIGS. 1A and 1B are views of a reflection cancelling boundary microphone in accordance with an embodiment of the invention.

Turning now to the drawings, reflection cancelling boundary microphones in accordance with embodiments of the invention are illustrated. The term reflection cancelling boundary microphone or RCBM is used to describe a class of microphone in which the microphone capsule is mounted within the pressure zone of a vibrating surface and the microphone is tuned in such a way as to cancel pressure waves reflected by the surface while admitting pressure waves generated by the vibration of the surface. The terms cancel and cancelling here are used to refer to the ability of the microphone to reduce the contribution of reflections to the audio signal generated by the microphone and are not intended to necessarily imply the complete cancellation of any contribution from reflections (although in many instances this may in fact be the objective of an RCBM). The extent to which an RCBM reduces the contribution of reflections from the vibrating surface (i.e., the zero effect of the RCBM) to the audio signal generated by the microphone depends upon the tuning of the microphone. In a number of embodiments, the RCBM includes a noise cancelling capsule mounted facing the vibrating surface in the pressure zone of the vibrating surface. Where a greater contribution from reflected sound is desired in the audio signal, other types of capsules can be used including but not limited to unidirectional, cardioid, or omni capsules and including multiple capsules in various phase relationships. In many embodiments, the microphone capsule is mounted in such a way as to filler mechanically borne vibrations in the operating range of the RCBM.

Reflection cancelling boundary microphones in accordance with embodiments of the invention can be used in amplification systems that amplify musical instruments. The RCBMs can be placed internally or externally. When the RCBM is directly mounted to the vibrating surface, it can be beneficial that the mass of the RCBM does not significantly alter the vibration of the surface. The RCBM can also be mounted so as to not touch the vibrating surface. In a number of embodiments, the amplification system combines the output of one or more RCBMs with the output from one or more pickups. For example, amplification systems intended to amplify instruments that incorporate lower frequencies such as acoustic guitars and double basses can pair one or more RCBMs with one or more conventional pickups such as, but not limited to, magnetic, undersaddle, stick-on, or soundhole pickups, or other types of microphones.

The outputs of an RCBM and a pickup can be combined using a crossover. An amplification system for an acoustic guitar can, for example, utilize an RCBM to amplify the guitar signal at frequencies above the primary resonance of the guitar top and use a pickup to handle the lowest frequency range of the instrument. In this way, the amplification can benefit from the rich sound captured by the microphone and use the pickup to capture the sound of the guitar in the region where the microphone is likely to suffer from feedback. In many embodiments, a crossover is used to filler the signals from the RCBM and the pickup and a mixer is also used to blend the filtered signals. Various embodiments of reflection cancelling boundary microphones, amplification systems, and crossover/mixer combinations in accordance with embodiments of the invention are discussed below.

Reflection Cancelling Boundary Microphones

RCBMs in accordance with embodiments of the invention are mounted facing a vibrating surface, and are tuned in such a way as to cancel reflections and admit the sound generated by the vibrating surface. RCBMs in accordance with many embodiments of the invention incorporate a microphone capsule that is mounted within the pressure zone of the vibrating surface, where the incident and reflected sounds combine effectively in phase over the audible range. In a number of embodiments, the microphone capsule is a noise cancelling capsule, where the front port of the noise cancelling capsule is oriented toward the vibrating surface and another port is more distant. Pressure waves that reflect off the vibrating surface reach both ports more or less equally, whereas pressure waves generated by the vibrating surface make more of a pressure gradient between the front and back of the noise cancelling capsule's diaphragm, causing it to move more. Where a different level of contribution from reflected sound is desired in the audio signal, other types of capsules can be used including but not limited to unidirectional, cardioid, or omni capsules and multiple capsules in various phase relationships. The selection of the capsule typically depends upon the application in which the reflection cancelling boundary microphone is being utilized.

Figure 1B:
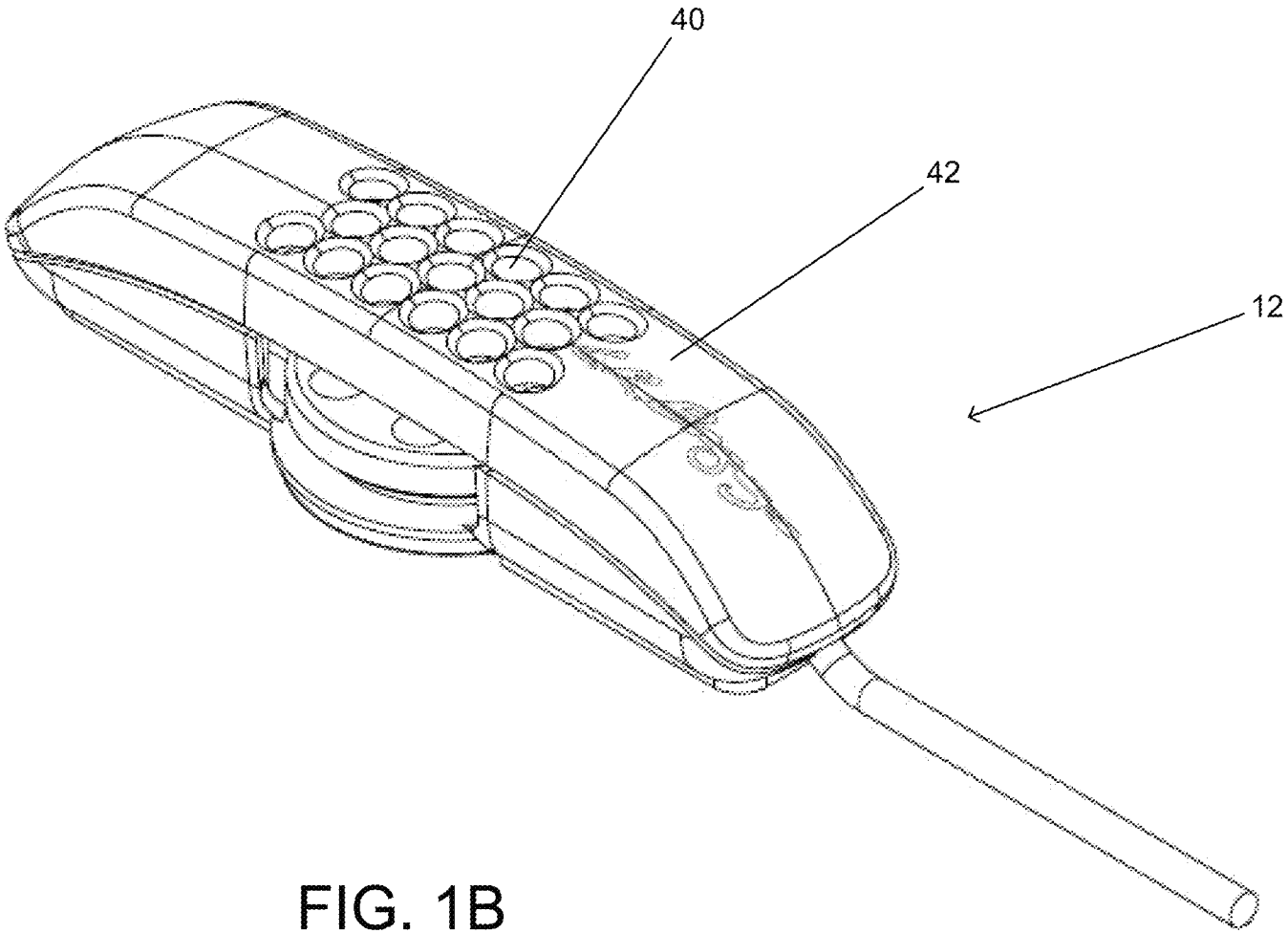

An RCBM incorporating a noise cancelling capsule in accordance with an embodiment of the invention is illustrated in FIGS. 1A and 1B. As can be seen in FIG. 1A, the front port 30 of the microphone capsule is configured to face a vibrating surface through a large circular opening 32 in the underside 34 of the microphone case. In FIG. 1B, the rear port of the noise cancelling microphone capsule faces the interior of the guitar through a number of small holes or openings 40 in the top case 42 of the RCBM.

In several embodiments, the microphone capsule of the RCBM is mounted within one inch of the top in the bridge plate area, which allows the RCBM to read the surface vibrations accurately while rejecting much of the cacophony of racket and reflections going on inside of the body of the instrument. In many instances, the RCBM is configured so that its microphone capsule is placed within a hall inch of the bridge plate. The performance of the microphone typically improves the closer the microphone capsule is placed to the vibrating surface and in several embodiments, the RCBM is configured so that the microphone capsule is mounted to be within 3 mm of the bridge plate.

When an RCBM is used in an acoustic guitar, a close proximity between the microphone capsule and the bridge plate area of the acoustic guitar energizes the microphone strongly enabling a very high sound pressure level to be used in live stage environments. The cancellation of reflections by the RCBM eliminates the honky boxy sound typical of internal microphones, because the boxy sound which typically inhabits the 400 Hz-1.5 kHz range is significantly reduced. Therefore, the frequency range of the microphone can be extended downward into this range, greatly enhancing the realism of the sound. The use of an RCBM in this manner nicely mimics the response of a studio microphone placed in the traditional recording manner outside of an instrument, such as an acoustic guitar.

Microphone Capsule Mounting

Any microphone that is constructed so that its microphone capsule is mechanically coupled to a vibrating surface can produce a very poor resulting output signal due to the amount of local vibration that can be transferred to the microphone capsule. In many embodiments, therefore, the microphone capsule of an RCBM is mounted in such a way as to mechanically decouple the microphone capsule from the vibrating surface in the operating range of the microphone. Effectively, the mounting of the microphone capsule fillers mechanically borne vibrations in the operating range of the microphone. In a number of embodiments, mechanically borne vibrations are filtered by tuning the resonant frequency of the structure used to mount the microphone capsule to the vibrating surface to a frequency below that of the operating range of the microphone. Factors that can influence the resonant frequency of the structure in which the microphone capsule is mounted are the mass of the structure and the compliance of the mounting. In several embodiments, an elastomer is used to shock mount the microphone capsule. In other embodiments, the microphone capsule can be suspended above the vibrating surface.

Figure 2:
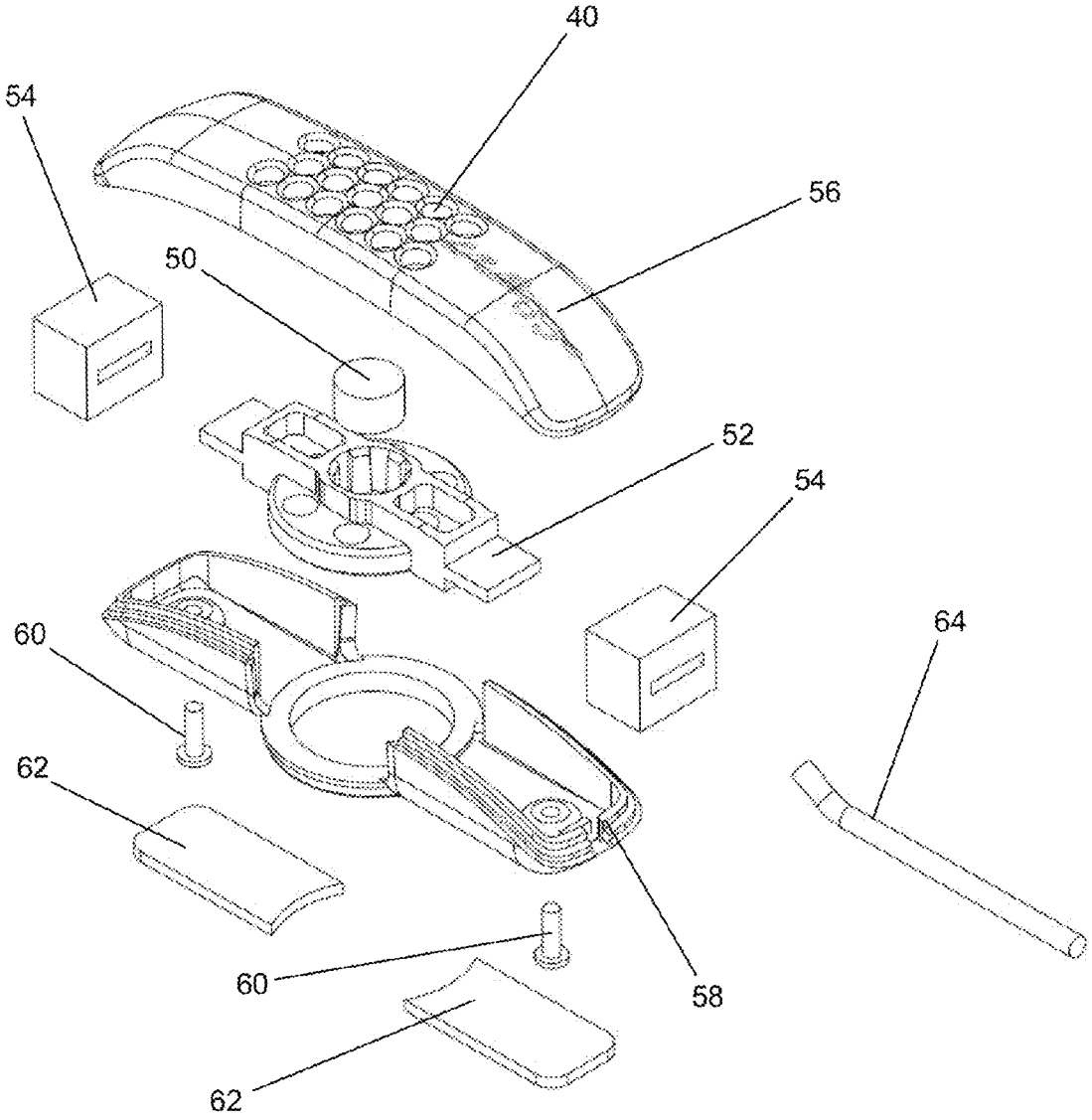
FIG. 2 is an exploded view of a reflection cancelling boundary microphone constructed in accordance with an embodiment of the invention.

An exploded view of the RCBM illustrated in FIGS. 1A and 1B is provided in FIG. 2 showing the mounting used to mechanically decouple the microphone capsule from a vibrating surface in the operating range of the microphone. The RCBM includes a microphone capsule 50, an armature 52 in which the microphone capsule is mounted, molded elastomer suspension shocks 54 that are used to shock mount the armature, a top case 56, a bottom case 58, screws 60 to secure the bottom case to the top case, and adhesive pads 62 for attaching the completed assembly to a musical instrument. A microphone wire 64 is also shown.

Figure 3:
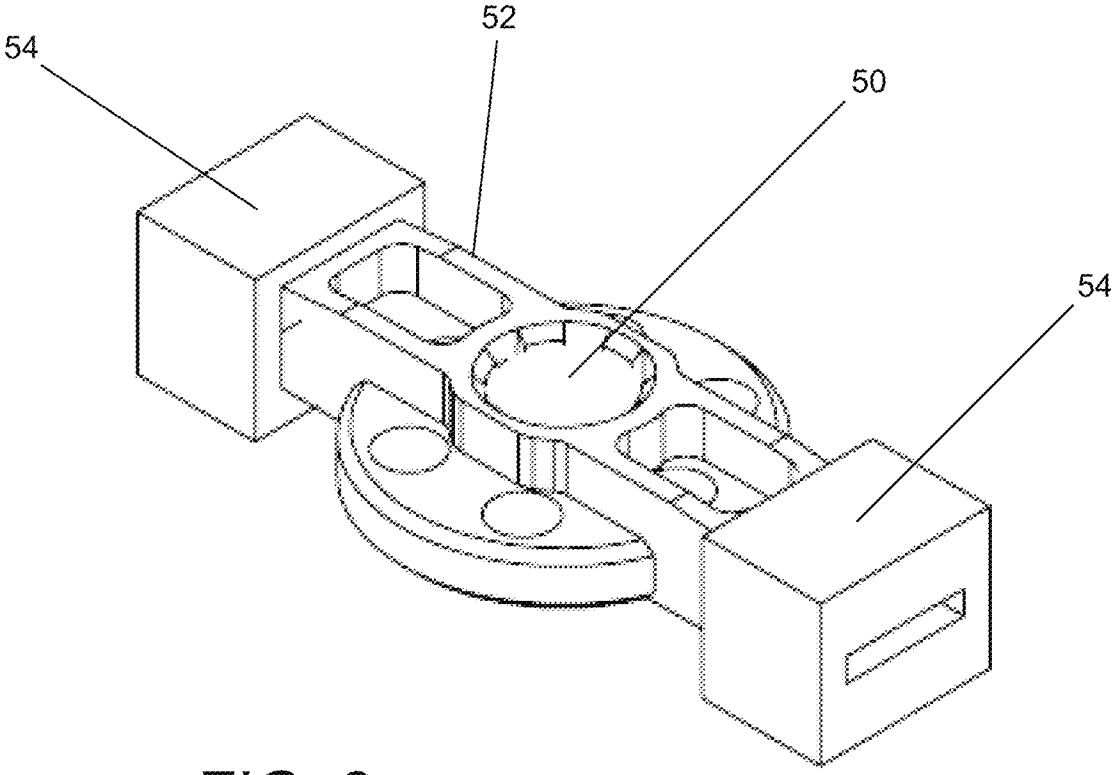
FIG. 3 is a perspective view of a microphone capsule mount in accordance with an embodiment of the invention.

The armature and the suspension shocks are constructed to create a mechanical low pass filter that filters or eliminates all of the mechanically borne frequencies in the operating range of the microphone. The assembly of the microphone capsule, armature and suspension shocks in accordance with an embodiment of the invention is illustrated in FIG. 3. In this way, mechanical filtering is applied to frequencies in the operating range of the microphone and lower frequency mechanical vibrations can be electronically filtered by crossover electronics. In the illustrated embodiment, the armature 52 is made from molded Zinc and the suspension shocks 54 are constructed from a moldable elastomeric material that can be tuned with different chemical components. In a number of embodiments, the armature and the suspension shocks are constructed so as to filter mechanical vibrations at least in the operating range of the microphone. In several embodiments, the armature and the suspension shocks are constructed to mechanically filter vibrations above approximately 150 Hz.

Referring back to FIGS. 1A & 1B, the top and bottom cases of the illustrated embodiment completely surround the armature and microphone capsule. To reduce the contribution of reflections to the generated audio signal, free air access is provided via openings in the bottom case, the top case and in the sides of the assembled case. The holes 40 in the top case are concentrated over the microphone capsule and enable the microphone capsule to receive enough air via its rear port to cancel reflections. Although a pattern of holes is shown, any of a variety of different opening configurations can be provided to enable propagating airborne frequencies to reach the microphone capsule.

Although an armature and suspension shocks are used to mount the microphone capsule shown in FIG. 3, any structure that fillers mechanical vibrations in the operating range of a RCBM can be used to mount a microphone capsule in accordance with embodiments of the invention.

Amplification Systems

In many embodiments, RCBMs are utilized in amplification systems for the amplification of musical instruments. Such amplification systems can simply utilize an RCBM to capture the sound of the instrument or can combine the RCBM with at least one other microphone or pickup to capture the sound of the instrument.

Figure 4:
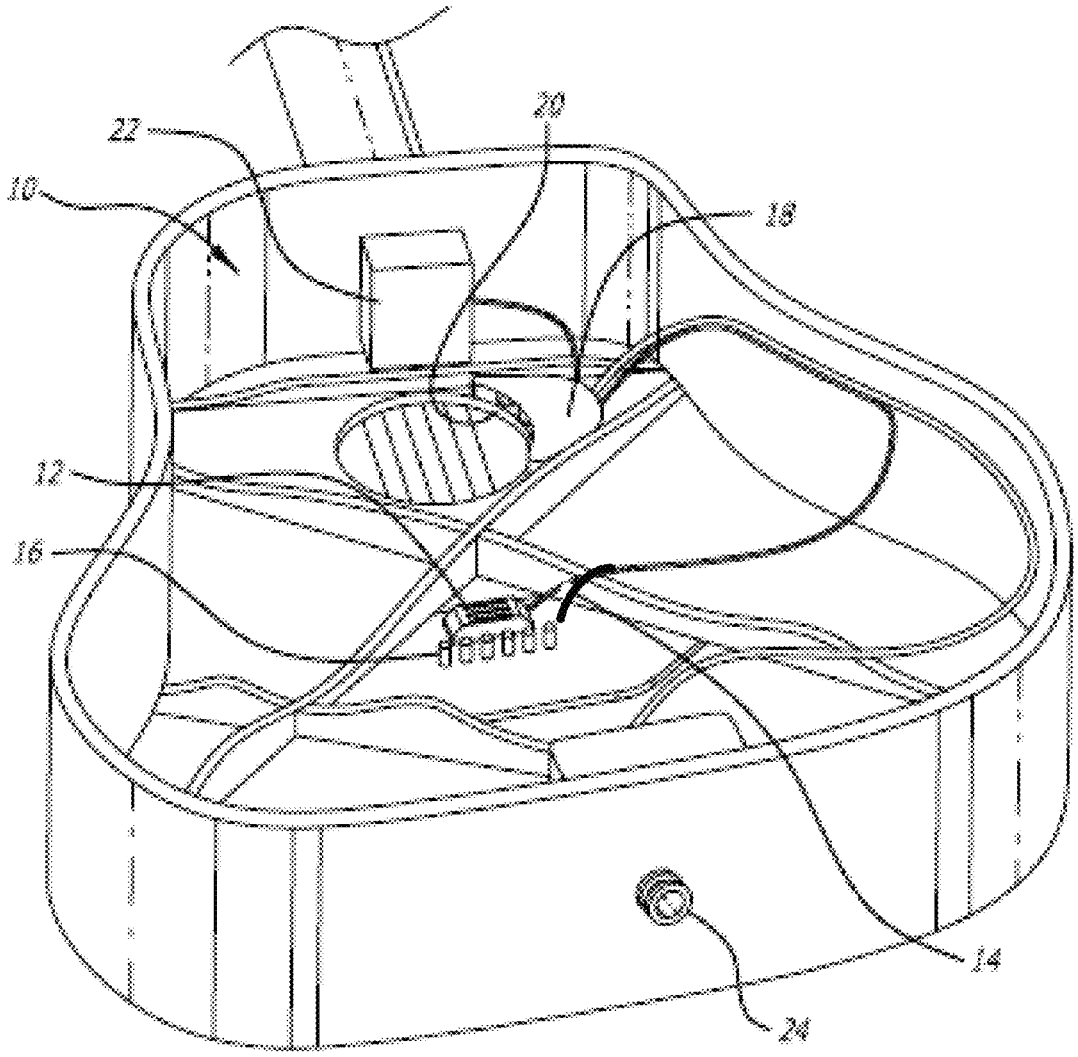
FIG. 4 is a perspective view of an amplification system including a reflection cancelling boundary microphone and an undersaddle pickup installed in a guitar in accordance with an embodiment of the invention.

An amplification system including an RCBM and an undersaddle pickup installed in an acoustic guitar in accordance with an embodiment of the invention is illustrated in FIG. 4. The amplification system 10 includes an RCBM 12 paired with an undersaddle pickup 14. The RCBM is mounted near the bridge on the underside of the top of the guitar using an adhesive elastomer and the undersaddle pickup is installed in the saddle slot in the bridge 16 of the guitar via a hole in the bridge. Both the RCBM and the pickup are connected to a crossover and mixer unit 18. In the illustrated embodiment, the crossover and mixer unit 18 is mounted adjacent the guitar's soundhole 20 and provides controls that can be used to control the mixing of the signal from the reflection cancelling boundary microphone and the pickup. The crossover and mixer unit is powered by a power supply 22 and the crossover and mixer unit is connected via wiring to a strap jack 24. In several embodiments, the amplification system can also include a pre-amplifier circuit that can be provided as part of the crossover and mixer unit or as a separate unit mounted within the guitar.

The crossover and mixer unit blends the output of the RCBM with the output of the pickup. The primary resonance of an acoustic guitar top is typically around 200 Hz-220 Hz and it is in this range the guitar is most susceptible to feedback. In addition, the air resonance of the sound box is around 150 Hz, which is another frequency region in which the guitar has a tendency to generate feedback. Therefore, the output of the RCBM is desirable above a cutoff frequency slightly above 220 Hz. Below the cutoff frequency, the output of the pickup can be used or blended with the microphone output to avoid feedback. The frequencies above the cutoff frequency can be referred to as the operating range of the RCBM and the frequencies below the cutoff frequency can be referred to as the operating range of the pickup. In several embodiments, the cutoff frequency is 250 Hz. In many embodiments, the cutoff frequency is above 300 Hz. In a number of embodiments, the pickup is provided to handle the lowest 3 octaves of the range of the acoustic guitar and the RCBM handles the upper 7 or 8 octaves of the guitar. The pickup used to provide a signal below the cutoff frequency can be any conventional pickup and in the embodiment shown in FIG. 4 is an undersaddle pickup, such as the Element transducer manufactured by L.R. Baggs Corporation. In other embodiments, any of a variety of pickups can be combined with a reflection cancelling boundary microphone. RCBMs and the implementation of crossovers in accordance with embodiments of the invention are discussed further below.

Figure 3A:
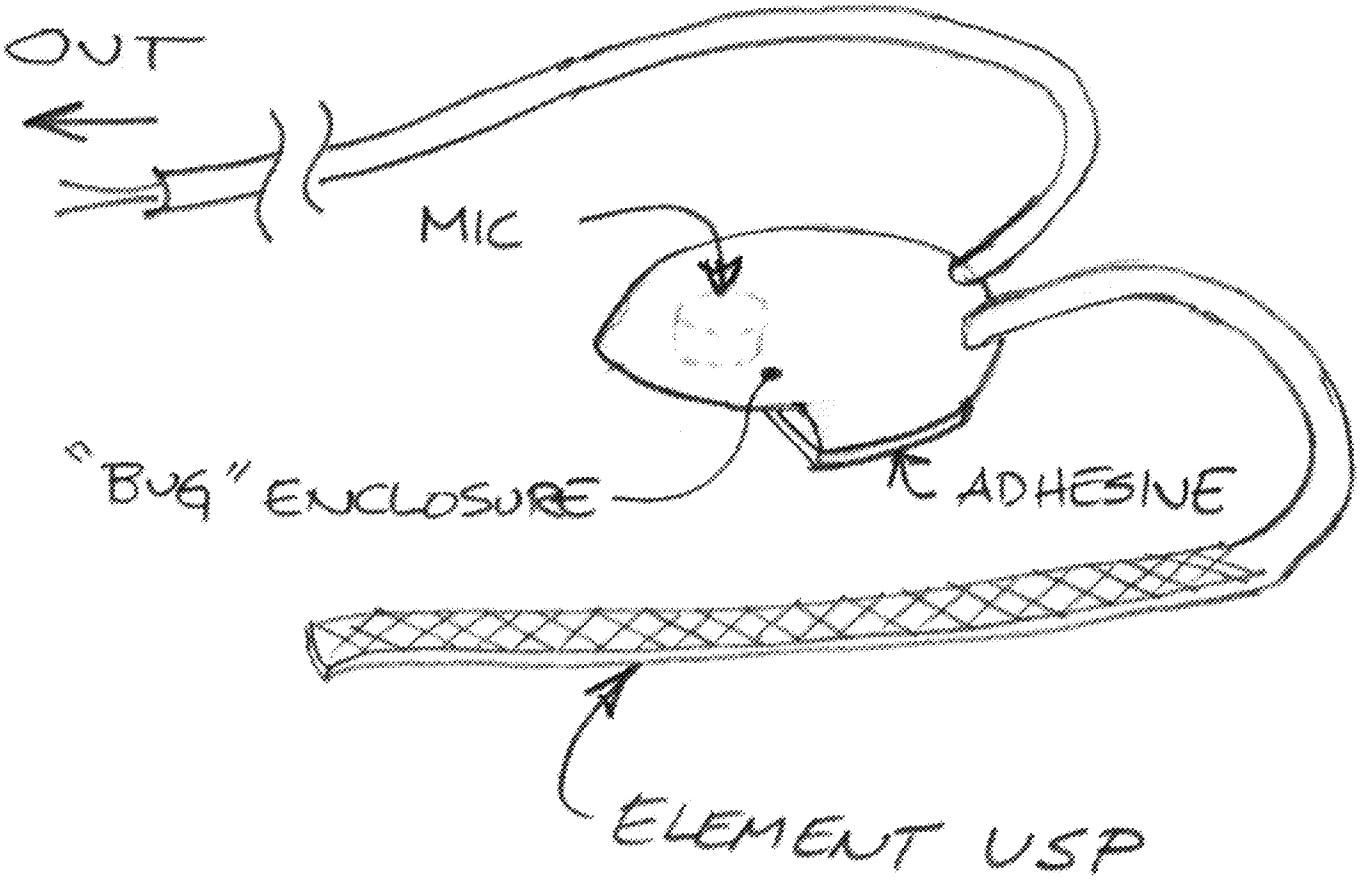
FIG. 3*a* is a perspective view of a bug enclosure in accordance with an embodiment of the invention.

The amplification system illustrated in FIG. 4 involves the separate mounting of the RCBM, the pickup, and the crossover circuitry within the guitar. In many embodiments, the flexibility of the microphone placement enables the combination of an RCBM and a pickup, such as an undersaddle pickup, into one assembly that attaches to the underside of the top of a guitar (or a surface on another instrument) with a foam adhesive pad. In several embodiments, a "bug" enclosure is provided containing the RCBM, an attachment for a shortened pickup, circuitry including the crossover circuitry and one output wire. A bug enclosure in accordance with an embodiment of the invention is illustrated in FIG. 3*a*. In the illustrated embodiment, the RCBM is combined with an undersaddle pickup. In other embodiments, the bug can combine an RCBM with any other transducer to obtain the low frequency components of the sound generated by the instrument. For example, a piezoelectric film could be incorporated into a bug enclosure to obtain low frequency information. In several embodiments, a piezoelectric film can be added to a microphone case similar to the microphone case illustrated in FIGS. 1A and 1B to provide low frequency information. This combination of an RCBM and pickup on one wire can provide considerable advantages during installation.

Although the amplification system shown in FIG. 4 is installed in an acoustic guitar and utilizes an undersaddle pickup in combination with an RCBM, amplification systems in accordance with embodiments of the invention that include RCBMs and that do not include a pickup, or that use the RCBM in combination with a different type of pickup and/or a different type of microphone can be utilized in the amplification of a variety of stringed instruments including but not limited to violins, mandolins, and pianos. As noted above, the RCBM can be located internally or externally to the instrument. In embodiments where the amplification system utilizes one or more pickups in combination with an RCBM, a crossover can be provided that outputs the signal generated by the RCBM above a specified frequency and outputs the signal generated by one or more pickups at and below the specified frequency. In several embodiments, the crossover outputs the signal generated by the RCBM at frequencies both above and below at least one frequency range. In many instances, the frequencies of interest may be completely unrelated to the feedback range of the instrument.

Crossover and Mixer Units

Figure 5:
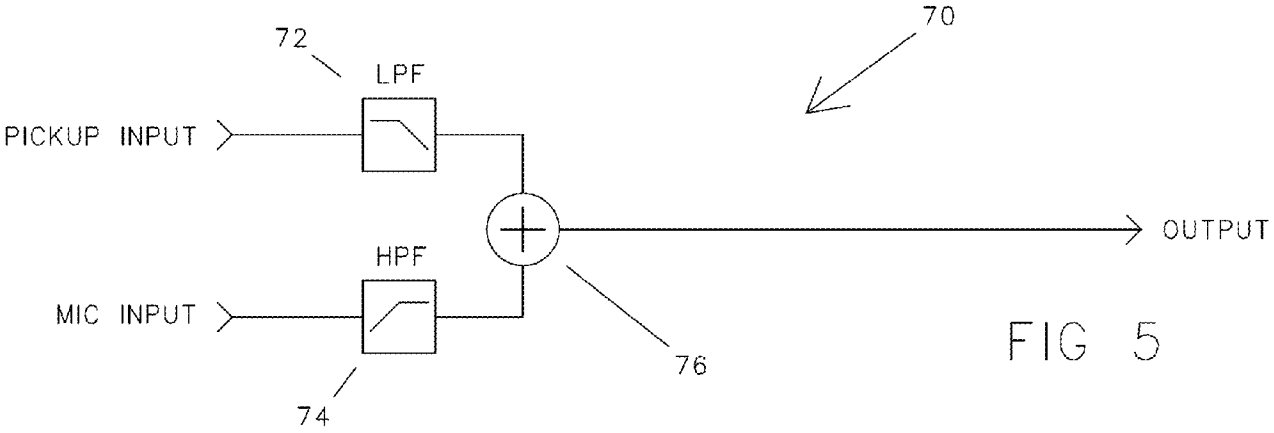
FIG. 5 is a circuit diagram illustrating a basic crossover circuit in accordance with an embodiment of the invention.

In many embodiments, a crossover is used to filler and/or a mixer is used to blend the output of an RCBM with the output of a pickup. As discussed above, a crossover can be used to filler the output of the RCBM to select frequencies above a frequency. For instance, a crossover can be used to select frequencies that are higher than the primary resonant frequency of the soundboard of an acoustic guitar. The crossover also filters the output of the pickup to select frequencies below the crossover frequency. A simple crossover circuit in accordance with an embodiment of the invention is illustrated in FIG. 5. The crossover circuit 70 applies a high pass filter 74 to the RCBM output and applies a low pass filter 72 to the pickup output and sums 76 the two filtered signals.

In a number of embodiments, the RCBM is managed by the crossover so that the microphone has an operating range where its lowest frequency is as close as possible to the primary resonance of the instrument. Therefore, a very steep crossover is used. The steepness of the crossover is typically dependent upon the cutoff frequency and its proximity to the primary resonant frequency of the soundboard of the guitar. For example, a high pass filter can be used to filter the output of the RCBM that has a cutoff frequency near 300 Hz with a slope of 24 dB/Octave to avoid typical guitar body resonances in the 200 Hz range. In addition, a low pass filter can be used to filler the output of the pickup that has a cut off frequency of 6 dB/Octave at around 300 Hz and of 12 dB/Octave at around 1 kHz. The combined signal is very realistic and it is highly resistant to feedback. In another example, a high pass filler can be used that has a lower cutoff frequency of 250 Hz and a steeper slope of 30 dB or 36 dB per octave. In many instances, the reflection cancelling characteristics of the microphone can be tuned to produce a roll off that achieves a similar effect to high pass filtering. Therefore, the severity of the slope of the high pass filler can be reduced or the high pass filter can be eliminated entirely. As can be readily appreciated, the specific cut off frequency and order of each of the high pass and low pass filters depends upon the requirements of a specific application and a desired sound quality. Indeed, successful amplification systems can be constructed using low pass filters having slopes in excess of 6 dB/Octave, 12 dB/Octave, and 24 dB/Octave, 30 dB/Octave, and 36 dB/Octave. When mounted inside of an instrument, an RCBM can be tuned to also mechanically filter low frequency pressure waves providing an even greater low frequency roll off effect and can be used to augment the electronic filtering. As can readily be appreciated, the frequency response of the filters in the crossover region can be tuned to provide a composite that accommodates the characteristics of the pickup and/or the microphone in the crossover region. For example, the crossover could include filters having poles at different frequencies.

Figure 6:
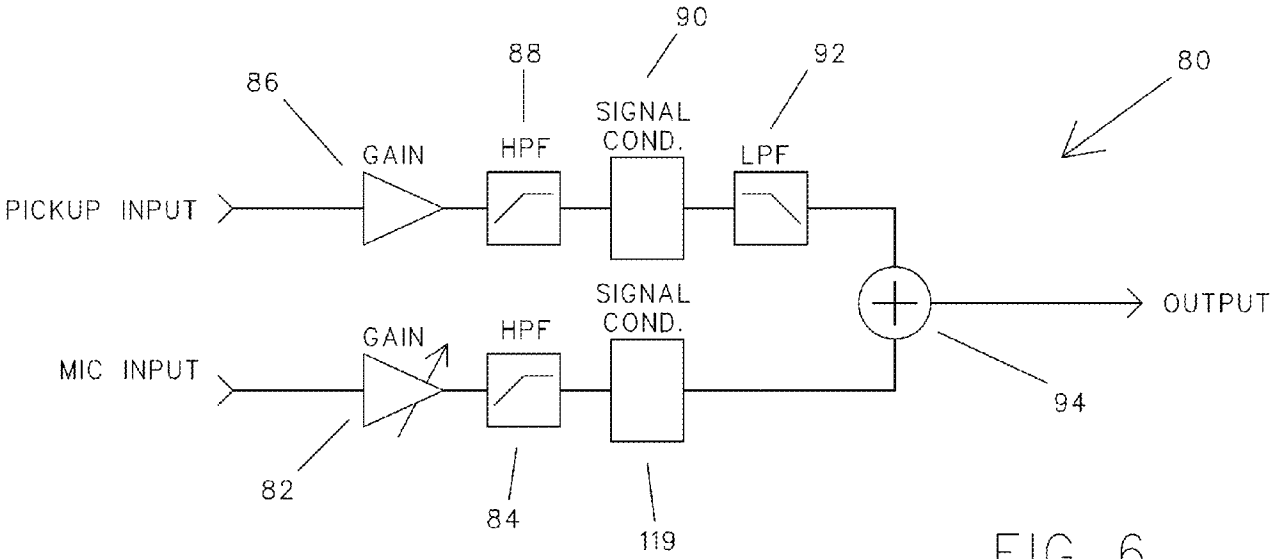
FIG. 6 is a circuit diagram of another embodiment of a crossover circuit in accordance with an embodiment of the invention.

In a number of embodiments, gain trimming potentiometers can be provided in the crossover to enable the fine-tuning of the response of the pickup and/or the response of the RCBM in the crossover region. In several embodiments, the gain trimming potentiometer can alter the amplitude of the microphone by ±10 dB. The amount that the gain trimming potentiometer alters response is typically a function of the requirements of a specific application. A crossover circuit including a gain trimming potentiometer in accordance with an embodiment of the invention is illustrated in FIG. 6. The crossover circuit 80 uses a gain trimming potentiometer 82 to control the amplification of the RCBM. The signal is then high pass filtered (84) and conditioned (119). The pickup output is also amplified (86) and high pass filtered [88) to remove undesirable low frequency thumps, bumps, and handling noise that are captured by the pickup (the high pass filtering could also be performed prior to the signal being provided to the crossover), and then the filtered signal is provided to a signal conditioning circuit 90. The output of conditioning circuit is then low pass filtered (92) and combined (94) with the high pass filtered and conditioned (119) microphone output. Again, the crossover frequencies and order of the fillers can be selected in accordance with the requirements of a specific instrument.

Figure 7:
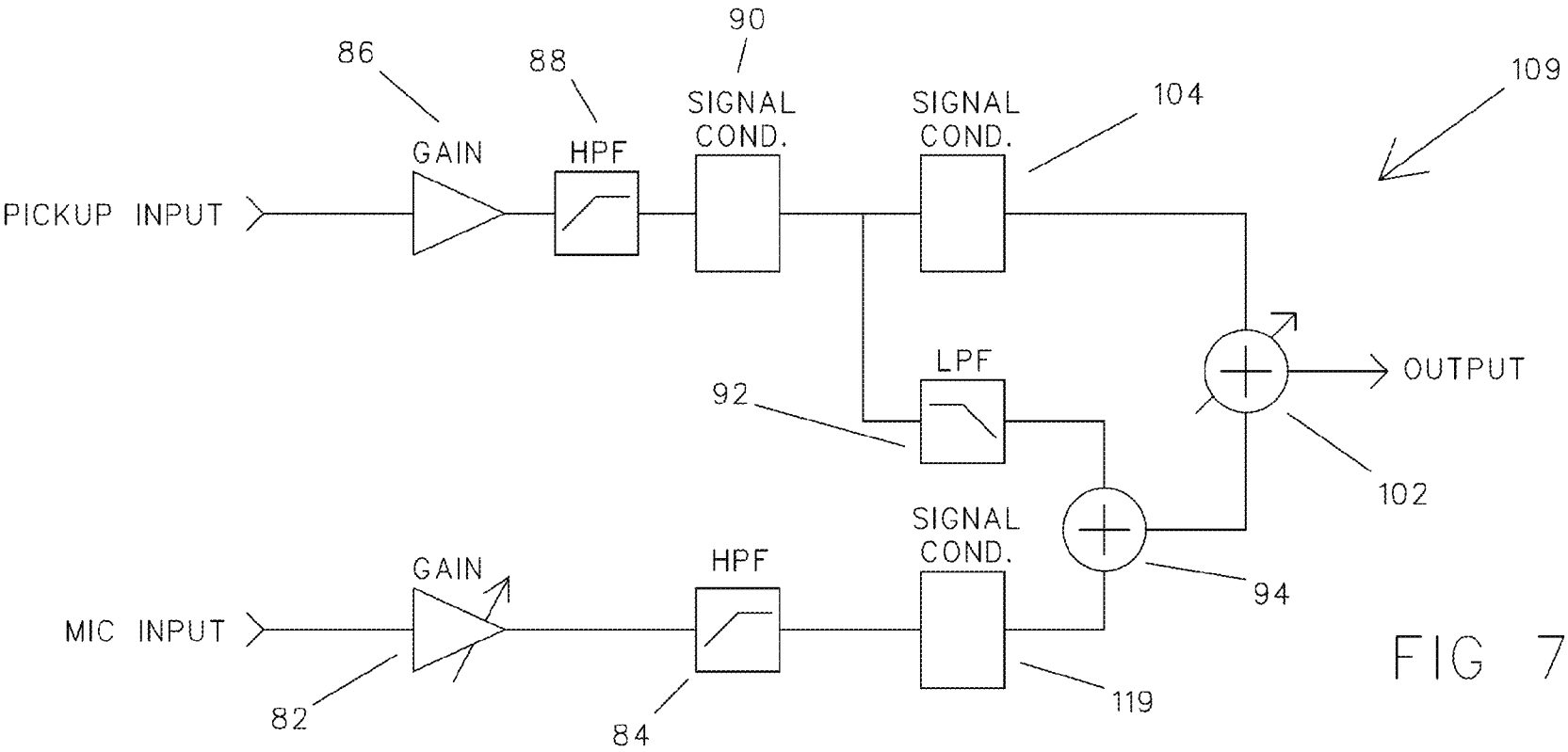
FIG. 7 is a circuit diagram of a further embodiment of a crossover circuit combined with a mixer circuit in accordance with an embodiment of the invention.

A crossover circuit including a mixer to blend the output of an RCBM with the output of a pickup in accordance with an embodiment of the invention is illustrated in FIG. 7. The crossover circuit 109 is basically the same as the crossover circuit 80 illustrated in FIG. 6 with the addition that the output of the circuit 80 illustrated in FIG. 6 is blended (102) with the conditioned (104) high pass filtered (88) pickup output. The output of the conditioning circuit 104 is the full frequency output of the pickup, which can be mixed with the combination of the RCBM and pickup signal produced by the crossover circuit 80 illustrated in FIG. 6.

Figure 8:
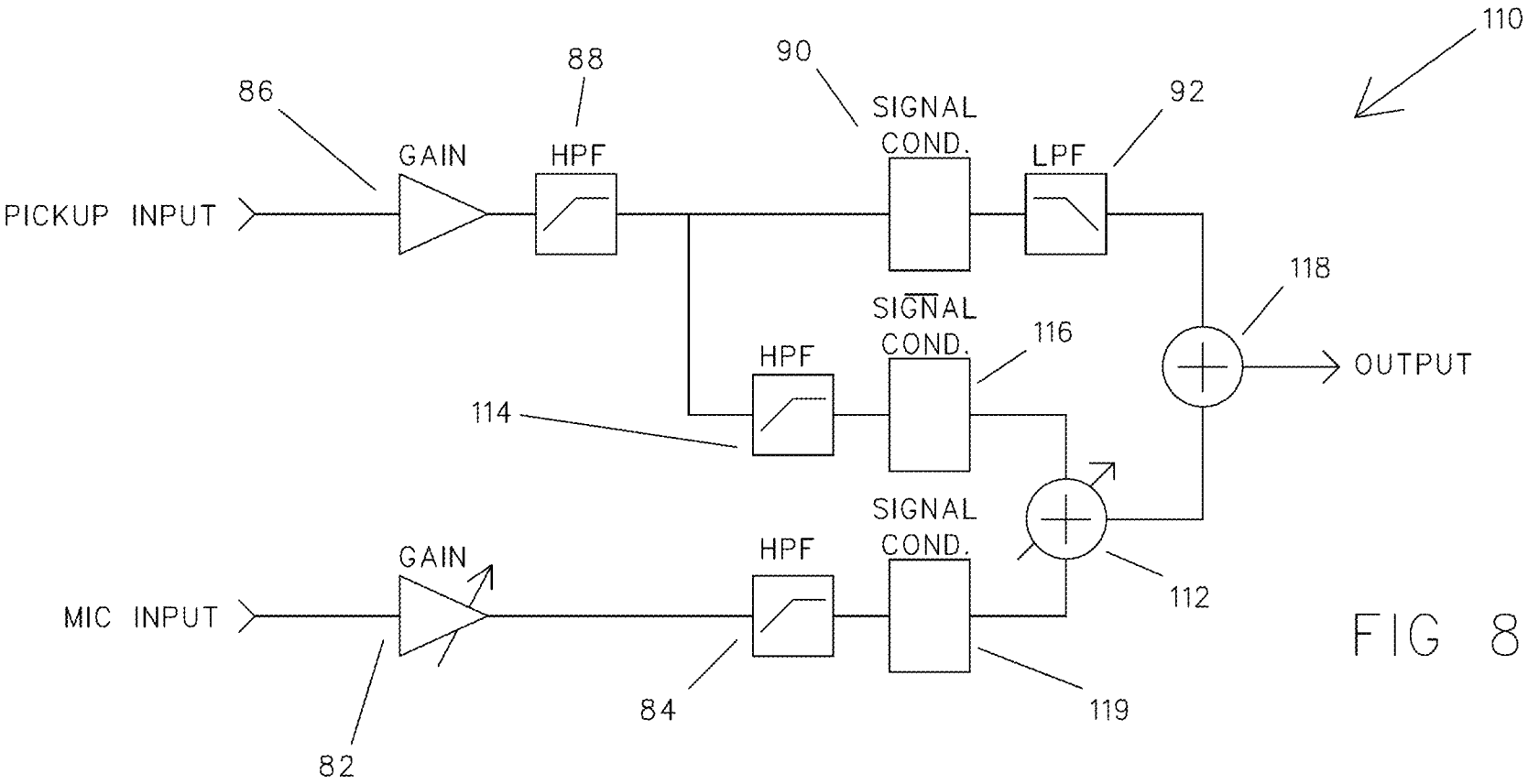
FIG. 8 is a circuit diagram of yet another embodiment of a crossover circuit combined with a mixer circuit in accordance with an embodiment of the invention.

Another crossover circuit including a mixer to blend the outputs of an RCBM with the output of a pickup in accordance with an embodiment of the invention is illustrated in FIG. 8. The crossover circuit 110 differs from the crossover circuit 109 illustrated in FIG. 7 in that the high pass filtered microphone output is mixed (112) with the same or similar frequencies of the pickup. A high pass filler 114 selects the same or similar frequencies for the pickup output as the operating range of the microphone and it is this signal that is mixed with the high pass filtered output of the RCBM. The output of the mixer is then combined (118) with the low pass filtered (92) pickup signal. In this way, the mix selects the contribution of the RCBM and the pickup to the high frequency components of the output of the crossover and mixer unit. The mix does not, however, impact the extent to which the pickup contributes to the sound below the cutoff frequency. In many embodiments, only mixing frequencies above the cutoff frequency can provide a smoother blend between the microphone and the pickup.

Figure 9:
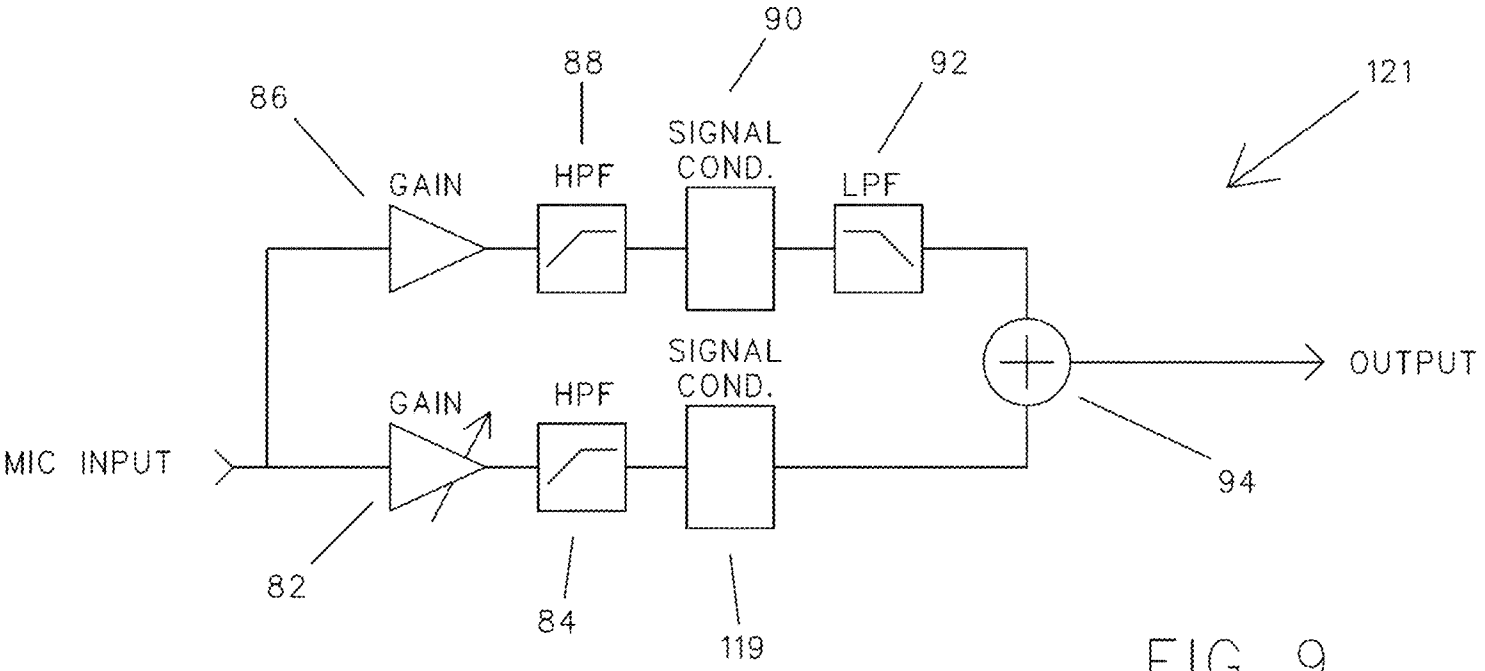
FIG. 9 is a circuit diagram of an additional embodiment of a crossover circuit combined with a mixer circuit in accordance with an embodiment of the invention.

A crossover used to condition the output of an RCBM in accordance with an embodiment of the invention is illustrated in FIG. 9. The crossover 121 splits the high frequencies and the low frequencies of the output of the RCBM and separately conditions these signals before recombining them. The high frequency path is the same as the path for the microphone signal in the crossover 80 illustrated in FIG. 6. The low frequency path is similar to the path for the pickup signal in the crossover 80 illustrated in FIG. 6. Instead of combining the high pass filtered and conditioned microphone output with the low pass filtered and conditioned output of a pickup, the microphone output is split and fed into both the high and low frequency paths and are conditioned separately to enable the use of a single RCBM to effectively cover the entire frequency spectrum of an instrument.

Although specific circuits are discussed above, any of a variety of circuits that filler and/or mix the outputs of an RCBM and a pickup in such a way as to suppress any feedback that may occur in the RCBM output at the resonant frequencies of the instrument can be utilized in accordance with embodiments of the invention. Furthermore, the natural roll off of the RCBM can be utilized to blend the output of the microphone with the output of the pickup without the need to high pass filler the output of the microphone.

While the above description contains many specific embodiments of the invention, these should not be construed as limitations on the scope of the invention, but rather as an example of one embodiment thereof. Accordingly, the scope of the invention should be determined not by the embodiments illustrated, but by the appended claims and their equivalents.

What is claimed is:

1. A reflection cancelling boundary microphone configured to generate a signal indicative of the sound generated by a vibrating surface, comprising:

a microphone capsule configured to be mounted within the pressure zone of a vibrating surface;

wherein the microphone capsule is a noise cancelling microphone capsule including at least a front port and rear port more distant than the front port from the vibrating surface;

wherein the microphone capsule is mounted so that the front port of the noise cancelling capsule is directed toward the vibrating surface; and wherein the at least front port and rear port of the microphone capsule are tuned to cancel pressure waves reflected by the vibrating surface while admitting pressure waves generated by the vibration of the vibrating surface.

2. The reflection cancelling boundary microphone of claim 1, wherein the microphone capsule is mounted to filter mechanically borne frequencies in the operating range of the microphone.

3. The reflection cancelling boundary microphone of claim 2, wherein:

microphone capsule is mounted to an armature; and the armature is suspended via elastomer supports.

4. The reflection cancelling boundary microphone of claim 1, wherein the microphone capsule is configured to be mounted within 1 inch of the vibrating surface.

5. The reflection cancelling boundary microphone of claim 4, wherein the microphone capsule is configured to be mounted within half an inch of the vibrating surface.

6. The reflection cancelling boundary microphone of claim 5, wherein the microphone capsule is configured to be mounted within 3 mm of the vibrating surface.

7. The reflection cancelling boundary microphone of claim 6, wherein the microphone capsule is configured to be mounted within 1 mm of the vibrating surface.

8. The reflection cancelling boundary microphone of claim 1, wherein the microphone capsule is mounted within a microphone case that includes openings to provide a path for pressure waves incident on the vibrating surface to reach the microphone capsule.

9. An amplification system configured to amplify the sound generated by a musical instrument, comprising:

a reflection cancelling boundary microphone, including a microphone capsule configured to be mounted within the pressure zone of a vibrating surface of a musical instrument;

wherein the microphone capsule is a noise cancelling microphone capsule including at least a front port and rear port more distant than the front port from the vibrating surface;

wherein the microphone capsule is mounted so that the front port of the noise cancelling capsule is directed toward the vibrating surface; and wherein the at least front port and rear port of the microphone are tuned to cancel pressure waves reflected by the vibrating surface while admitting pressure waves generated by the vibration of the vibrating surface.

10. The amplification system of claim 9, wherein the reflection cancelling boundary microphone is configured to be mounted on an internal surface of a musical instrument.

11. The amplification system of claim 9, wherein the reflection cancelling boundary microphone is configured to be mounted on an external surface of a musical instrument.

12. The amplification system of claim 9, further comprising:

a pickup configured to generate a signal indicative of sound; and a crossover;

wherein the crossover combines the output of the reflection cancelling boundary microphone and the pickup.

13. The amplification system of claim 12, wherein the pickup is selected from the group consisting of undersaddle, magnetic, soundhole, and stick-on pickups.

14. The amplification system of claim 12, wherein the pickup is an undersaddle pickup.

15. The amplification system of claim 12, wherein the crossover is configured to filter the output of the reflection cancelling boundary microphone to select frequencies above a crossover frequency that is higher than a primary resonant frequency of a musical instrument.

16. The amplification system of claim 15, wherein:

the musical instrument is an acoustic guitar; and the crossover frequency is at least 250 Hz.

17. The amplification system of claim 15, wherein the crossover is further configured to filter the output of the pickup to select frequencies below the crossover frequency.

18. The amplification system of claim 12, further comprising:

a mixer;

wherein the crossover is configured to high pass filter the output of the reflection cancelling boundary microphone to select frequencies above a crossover frequency that is higher than a primary resonant frequency of a musical instrument;

wherein the crossover is configured to high pass filter the output of the pickup to select frequencies above the crossover frequency;

wherein the mixer is configured to blend the high pass filtered outputs of the reflection cancelling boundary microphone and the pickup;

wherein the crossover is also configured to low pass filter the output of the pickup; and wherein the crossover is configured to combine the output of the mixer with the low pass filtered output of the pickup.

19. The amplification system of claim 12, wherein the microphone and the pickup are mounted within a unitary housing.

20. The amplification system of claim 19, wherein the pickup is any transducer that generates a signal indicative of the low frequency sound generated by the instrument.

21. The amplification system of claim 20, wherein the pickup can be selected from the group consisting of an undersaddle pickup, and a film pickup internal to the unitary housing.

22. The amplification system of claim 9, further comprising:

a crossover;

wherein the crossover is configured to split a signal generated by the RCBM and separately filter the high frequency and low frequency components of the signal and then recombines the filtered components to provide a crossover output signal.

* * * * *